US007360579B2

(12) United States Patent
Renkel et al.

(10) Patent No.: US 7,360,579 B2
(45) Date of Patent: Apr. 22, 2008

(54) METHOD FOR THE PRODUCTION OF CAST COMPONENTS

(75) Inventors: Manfred Renkel, Petershausen (DE); Wilfried Smarsly, München (DE)

(73) Assignee: G4T GmbH, Pretzfeld (DE)

( * ) Notice: Subject to any disclaimer, the term of this patent is extended or adjusted under 35 U.S.C. 154(b) by 0 days.

(21) Appl. No.: 10/585,978

(22) PCT Filed: Dec. 22, 2004

(86) PCT No.: PCT/DE2004/002801

§ 371 (c)(1),
(2), (4) Date: Sep. 21, 2006

(87) PCT Pub. No.: WO2005/071128

PCT Pub. Date: Aug. 4, 2005

(65) Prior Publication Data

US 2007/0151696 A1 Jul. 5, 2007

(30) Foreign Application Priority Data

Jan. 21, 2004 (DE) ..... 10 2004 002 956

(51) Int. Cl.
*B22D 27/00* (2006.01)
*B22D 27/20* (2006.01)

(52) U.S. Cl. ..... 164/57.1; 164/58.1; 164/59.1

(58) Field of Classification Search ..... 164/57.1
See application file for complete search history.

(56) References Cited

U.S. PATENT DOCUMENTS 5,348,595 A * 9/1994 Hanamura et al. ..... 148/538
5,429,796 A 7/1995 Larsen
2004/0253136 A1* 12/2004 Shamblen et al. ..... 419/34

FOREIGN PATENT DOCUMENTS

EP 0 634 496 A1 1/1995

OTHER PUBLICATIONS

Pyo-Chun Park, Chang-Woo Choi, Chun-Pyo Hong: "A Study on the Melting and Casting of TiA1 Intermetallic Compound by VIM Process" Journal of the Korean Institute of Metallurgy and Materials, vol. 29, No. 6, 1991, pp. 562-569, XP008056446, Seoul.

* cited by examiner

*Primary Examiner*—Kuang Lin
(74) *Attorney, Agent, or Firm*—Manabu Kanesaka

(57) ABSTRACT

The invention relates to a method for the production of a cast component, in particular a gas turbine component. The inventive method comprises at least the following steps: a) a crucible and at least one semi-finished product is prepared from an intermetallic titanium-aluminium material; b) the or each semi-finished product made of intermetallic titanium-aluminium material is melted in the crucible; c) at least one additional element or an additional compound is added to the melt, whereby the or each element and/or the or each compound is introduced into the melt according to the melting temperature thereof; d) a casting mold is prepared; e) the casting mold is filled with the melt; f) the melt is solidified in the casting mold; g) the casting component is extracted from the casting mold.

11 Claims, No Drawings

METHOD FOR THE PRODUCTION OF CAST COMPONENTS

BACKGROUND OF THE INVENTION

The invention relates to a method for the production of a cast component as defined in the preamble of patent claim 1.

The present invention relates to the production of cast components, in particular the production of gas turbine components, using a casting method. During casting, molds, so-called casting molds, are used, wherein the casting molds have an interior contour corresponding to the exterior contour of the component to be produced. In principle a differentiation is made between casting methods which work with lost casting molds or permanent casting molds. With casting methods which work with lost casting molds, only one component can be produced with one casting mold. With casting methods which work with permanent casting molds, the casting molds can be used several times. Among others, so-called precision casting belongs to the casting methods which work with lost casting molds. For casting methods which work with permanent casting molds, refer to gravity casting as an example.

To produce a component using casting, a material from which the component to be produced is to be made is melted in a melting crucible, and the melted material is poured into the casting mold. When the material is melted, all elements or compounds involved in the creation of the material are melted simultaneously in accordance with the prior art. During this, a problem occurs in that volatile elements such as, for example, manganese or aluminum, can vaporize, thus resulting in the loss of these elements. The desired composition of the material from which the component to be produced is to be cast in accordance with the prior art can only be achieved with high material losses.

SUMMARY OF THE INVENTION

The present invention is based on the problem of creating a novel method for producing a cast component.

This problem is solved by further developing the initially mentioned method by adding the features of the characteristic portion of patent claim 1. The method provided by the invention consists of at least the following steps: a) provision of a melting crucible and at least one semi-finished product made of an intermetallic titanium-aluminum material; b) melting of the semi-finished product or each semi-finished product from the intermetallic titanium-aluminum material in the melting crucible; c) adding at least one additional element or an additional compound to the molten mass, wherein the element or each element and/or the compound or each compound is added to the molten mass based on the melting temperature; d) provision of a casting mold; e) pouring the molten mass into the casting mold; f) hardening of the molten mass in the casting mold; g) removal of the cast component from the casting mold.

DETAILED DESCRIPTION

Preferred further developments of the invention result from the dependent claims and the following description. In the following, the present method for the production of cast components, in particular gas turbine cast components, will be described in more detail.

In a first step of the method provided by the invention, a melting crucible and a semi-finished product made of a intermetallic titanium-aluminum material are provided. The semi-finished product made of the intermetallic titanium-aluminum material can be, for example, a Ti45AI semi-finished product or also a Ti55AI semi-finished product, depending on the desired proportion of titanium in the material for the cast component to be produced. The melting crucible can be a graphite crucible or a cold wall crucible.

In a second step of the method provided by the invention, the semi-finished product or each semi-finished product is melted in the melting crucible. The melting crucible is inductively warmed up to melt the semi-finished product or each semi-finished product.

After the molten mass made of the melted-on titanium-aluminum semi-finished product has been warmed up, additional elements and/or additional compounds are added to the molten mass. During this, refractory elements or compounds are added first to the molten mass, followed by volatile elements or compounds and, if necessary, fine materials. The refractory additional elements or compounds can be tungsten, tantalum, or niobium. Furthermore, titanium can be added as refractory additional element, which is done in particular when the proportion of titanium in the material must be increased. After the refractory elements have been added to the molten mass, volatile elements such as, for example, manganese, can be added to the molten mass. Afterwards fine materials such as, for example, titanium boride or titanium diboride can be added to the molten mass. The additional elements and/or compounds are thus added to the molten mass based on their melting temperatures, wherein such elements and/or compounds which have a high melting point are added first. The elements and/or compounds with a low melting point are added to the molten mass last. The above elements can be added to the molten mass as pure metals or alloys.

In the sense of the present invention, the elements and/or compounds are added to the molten mass in defined doses and/or amounts. In the sense of the invention, the respective dose and/or amount of the element to be added and/or the compound to be added is measured so that, assuming a molten mass temperature prior to the addition (for example 1600° C.), the temperature of the molten mass is always greater than 1550° C. after the element and/or the compound has been added, and, furthermore, the temperature before the addition will be reached again after a maximum of 15 minutes. This ensures that only slight temperature fluctuations occur in the molten mass when additional elements and/or compounds are added to the molten mass.

Furthermore, in the sense of the present invention, the respective dose and/or amount of the elements and/or compounds to be added is measured so that the dose and/or amount to be added has a maximum weight of 250 g at an element density and/or compound density greater than 6 g/cm$^3$. In contrast, if the element density and/or compound density is below 6 g/cm$^3$, the weight of the dose and/or amount of the element and/or the compound to be added is a maximum of 50 g. Also through this, it is ensured that the molten mass is only subjected to slight fluctuations when the additional elements and/or compounds are added.

As already mentioned, the semi-finished product made of the intermetallic titanium-aluminum material to which the additional elements and/or compounds will be added is inductively warmed up and/or heated in the melting crucible. The additional elements and/or compounds are added in situ during the melting process, in other words, during the inductive warming up. The inductive warm-up system creates a field of chaotic currents within the molten mass so that partial alloying and homogenizing with the volatile and/or refractory elements or compounds can be realized.

The inductive system induces eddy flows and creates a flow within the molten mass. In the sense of the present invention, the element or each element and/or the compound or each compound is added to the molten mass in defined, flow-optimized geometry. Flow-optimized geometry means that the flow-optimized geometry provides good transportation of the element or each element and/or the compound or each compound within the molten mass. To optimize the flow within the molten mass, the additional elements or compounds added to the molten mass are plane and/or discoidal shaped elements. This ensures that the additional elements and/or compounds which are to be added to the molten mass are finely distributed throughout the molten mass.

The method provided by the invention makes it possible to inexpensively produce cast components for gas turbines. A high chemical homogeneity of the cast components can be realized based on intermetallic phases.

The invention claimed is:

1. A method for the production of a cast component, comprising the steps of:

a) providing a melting crucible and at least one semi-finished product made of an intermetallic titanium-aluminum material;

b) melting of the semi-finished product or each semi-finished product made of the intermetallic titanium-aluminum material in the melting crucible;

c) adding of a plurality of additional elements or additional compounds to the molten mass in succession depending on their melting temperature wherein at least one element and/or one compound with a high melting point is added to the molten mass first, followed by at least one further element and/or one further compound with a lower melting point, d) providing a casting mold;

e) pouring the molten mass into the casting mold;

f) hardening of the molten mass in the casting mold; and g) removing the cast component from the casting mold.

2. The method according to claim 1, wherein refractory additional elements or compounds are added first to the molten mass, followed by volatile additional elements or compounds and then, if necessary, fine materials.

3. The method according to claim 2, wherein tungsten, tantalum, niobium and, if necessary, titanium or alloys of these elements are added as refractory additional elements to the molten mass.

4. The method according to claim 2, wherein manganese or an alloy of this element is added as volatile additional element to the molten mass.

5. The method according to claim 2, wherein titanium boride is added as fine material to the molten mass.

6. The method according to claim 1, wherein element or each element and/or the compound or each component is added to the molten mass in defined doses and/or amounts, wherein the respective dose and/or amount is measured such that, a molten mass temperature prior to the addition is attained within 15 minutes after the addition when the temperature after the addition is greater than 1550° C.

7. The method according to claim 1, wherein the additional element or each additional element and/or the additional compound or each additional compound is added to the molten mass in defined doses and/or amounts, wherein the respective dose and/or amount has a maximum weight of 250 g at an element and/or compound density of greater than 6 g/cm$^3$.

8. The method according to claim 1, wherein the additional element or each additional element and/or the additional compound or each additional compound is added to the molten mass in defined doses and/or amounts, wherein the respective dose and/or amount has a maximum weight of 50 g at an element and/or compound density of less than 6 g/cm$^3$.

9. The method according to claim 1, wherein the additional element or each additional element and/or the additional compound or each additional compound is added to the molten mass in a optimized geometry.

10. The method according to claim 9, wherein the optimized geometry enables good transportation of the element or each element or the compound or each compound within the molten mass.

11. The method according to claim 1, wherein, during the melting process, the melting crucible is inductively warmed up and/or heated along with the semi-finished product or each semi-finished product and the element or each element, as well as the compound or each compound in the melting crucible.

* * * * *